US010011897B2

(12) United States Patent
Gusek et al.

(10) Patent No.: US 10,011,897 B2
(45) Date of Patent: Jul. 3, 2018

(54) METHOD AND DEVICE FOR HOT-DIP COATING A METAL STRIP WITH A METAL COVERING

(71) Applicant: ThyssenKrupp Steel Europe AG, Duisburg (DE)

(72) Inventors: Christopher Gusek, Iserlohn (DE); Joerg Schulte, Finnentrop (DE); Marc Blumenau, Hagen (DE); Fred Jindra, Lennestadt (DE); Dirk Czupryna, Duisburg (DE); Rudolf Schoenenberg, Daphne, AL (US)

(73) Assignee: ThyssenKrupp Steel Europe AG, Duisburg (DE)

( * ) Notice: Subject to any disclaimer, the term of this patent is extended or adjusted under 35 U.S.C. 154(b) by 42 days.

(21) Appl. No.: 14/357,427

(22) PCT Filed: Oct. 11, 2012

(86) PCT No.: PCT/EP2012/070180

§ 371 (c)(1),
(2) Date: May 9, 2014

(87) PCT Pub. No.: WO2013/068196

PCT Pub. Date: May 16, 2013

(65) Prior Publication Data

US 2015/0140225 A1 May 21, 2015

(30) Foreign Application Priority Data

Nov. 11, 2011 (DE) ..... 10 2011 118 197

(51) Int. Cl.
*C23C 2/40* (2006.01)
*B05C 11/06* (2006.01)
(Continued)

(52) U.S. Cl.
CPC ..... *C23C 2/40* (2013.01); *B05C 11/06* (2013.01); *C23C 2/00* (2013.01); *C23C 2/003* (2013.01);
(Continued)

(58) Field of Classification Search
CPC .. C23C 2/40; C23C 2/00; C23C 2/003; C23C 2/14; C23C 2/16; C23C 2/18; C23C 2/20; B05C 11/06; B05C 11/021; B05D 7/142
USPC ..... 118/62, 63, 419; 427/432, 435, 348, 349
See application file for complete search history.

(56) References Cited

U.S. PATENT DOCUMENTS 3,667,425 A * 6/1972 Bozeman ..... C23C 2/20 118/63
5,084,094 A 1/1992 Francois et al.
(Continued)

FOREIGN PATENT DOCUMENTS

DE 4223343 C1 3/1994
DE 4300868 C1 3/1994
(Continued)

OTHER PUBLICATIONS

English Translation of JP 6-256923, Okamoto et al, published Sep. 13, 1994.*

*Primary Examiner* — Laura Edwards
(74) *Attorney, Agent, or Firm* — The Webb Law Firm

(57) ABSTRACT

The invention relates to a device and a method for hot-dip coating a metal strip with a metal covering, wherein the metal strip is directed continuously through a melt bath, wherein the thickness of the metal covering present on the metal strip when it leaves the melt bath is adjusted by means of a scraping device, and wherein slag which is present on the melt bath is driven away from the metal strip leaving the melt bath by means of a gas flow. To prevent slag from coming into contact with the metal strip leaving the melt bath, the invention drives away the slag from the metal strip by means of at least one nozzle which is arranged in close proximity to the metal strip, that a gas flow which extends over the width of the metal strip is directed onto the surface of the melt bath.

5 Claims, 5 Drawing Sheets

(51) Int. Cl.

| | |
|---|---|
| ***C23C 2/00*** | (2006.01) |
| ***C23C 2/14*** | (2006.01) |
| ***C23C 2/16*** | (2006.01) |
| ***C23C 2/18*** | (2006.01) |
| ***C23C 2/20*** | (2006.01) |
| *B05D 7/14* | (2006.01) |
| *B05C 11/02* | (2006.01) |

(52) U.S. Cl.
CPC ..... *C23C 2/14* (2013.01); *C23C 2/16* (2013.01); *C23C 2/18* (2013.01); *C23C 2/20* (2013.01); *B05C 11/021* (2013.01); *B05D 7/142* (2013.01)

(56) References Cited

U.S. PATENT DOCUMENTS

| | | | | |
|---|---|---|---|---|
| 6,177,140 | B1 | 1/2001 | Patil et al. | |
| 6,426,122 | B1 | 7/2002 | Ishii et al. | |
| 8,464,654 | B2 | 6/2013 | Barjon et al. | |
| 2010/0323095 | A1 | 12/2010 | Barjon et al. | |
| 2011/0018178 | A1* | 1/2011 | Muller | B21B 45/004 266/44 |

FOREIGN PATENT DOCUMENTS

| | | | | |
|---|---|---|---|---|
| DE | 102006030914 | A1 | | 1/2008 |
| EP | 2100673 | A1 | * | 9/2009 |
| JP | 5554358 | U1 | | 4/1980 |
| JP | 06256923 | A | * | 9/1994 |
| JP | 7145460 | A | | 6/1995 |
| JP | 860327 | A | | 3/1996 |
| JP | 10158796 | A | | 6/1998 |
| JP | 10158797 | A | | 6/1998 |
| JP | 11279730 | A | | 10/1999 |
| JP | 200542151 | A | | 2/2005 |
| WO | 2009098362 | A1 | | 8/2009 |
| WO | 2009098363 | A1 | | 8/2009 |

* cited by examiner

METHOD AND DEVICE FOR HOT-DIP COATING A METAL STRIP WITH A METAL COVERING

CROSS-REFERENCE TO RELATED APPLICATIONS

This application is the United States national phase of International Application No. PCT/EP2012/070180 filed Oct. 11, 2012, and claims priority to German Patent Application No. 10 2011 118 197.4 filed Nov. 11, 2011, the disclosures of which are hereby incorporated in their entirety by reference.

BACKGROUND OF THE INVENTION

Field of the Invention

The invention relates to a method for hot-dip coating a metal strip with a metal covering, wherein the metal strip is directed continuously through a melt bath, wherein the thickness of the metal covering which is present on the metal strip when it leaves the melt bath is adjusted by means of a scraping device, and wherein slag which is present on the melt bath is driven away from the metal strip leaving the melt bath by means of a gas flow. Typically, the metal strips which are coated in this manner are hot or cold-rolled steel strips.

The invention also relates to a device for hot-dip coating a metal strip with a metal covering, this device comprising a melt bath, a conveying device for continuously directing the metal strip through the melt bath, a scraping device for adjusting the thickness of the metal covering which is present on the metal strip when it leaves the melt bath and at least one nozzle for producing a gas flow which drives away slag present on the melt bath from the metal strip leaving the melt bath.

Description of Related Art

The continuous hot-dip processing of the type mentioned in the introduction is an industrially established, economically and ecologically advantageous method principle with which flat metal products can be coated with a metal covering, for example, for the purposes of corrosion protection. The hot-dip processing of a previously in-line recrystallisation annealed metal strip with a Zn (hot galvanising) or aluminium alloy covering (hot aluminium coating) is thus highly significant for the production of semi-finished products for metal sheet applications in automotive engineering, household appliance construction and mechanical engineering.

During the continuous hot-dip processing operation, the annealed metal strip is directed through a melt bath, which comprises a melt of the metal which forms the respective covering or the metal alloy which forms the respective covering and is then redirected within the melt bath via a roller system at least once and stabilised in terms of its path until it leaves the melt bath. Excess covering material which is still molten is then scraped away by means of scraping nozzles after leaving the coating bath. The scraping is generally carried out in this instance by blowing by means of a gas flow. However, scraping systems which function in a purely mechanical manner are also used.

During the immersion phase in the coating bath, some of the steel material of the steel strip is inevitably always dissolved in the coating bath. At the same time, the molten coating bath is permanently in direct contact with the ambient air. Both lead to an unavoidable build-up of slag in the melt bath. This slag floats on the metal bath as so-called "upper slag".

If upper slag is carried along by the metal strip leaving the coating bath, the coating quality can be impaired in a lasting manner by the resulting defect locations. For example, so-called "smearing strips" appear or the strip is damaged by means of impressions when the carried slag accumulates on subsequent rollers and becomes baked on. This sometimes leads to considerable costs owing to subsequent processing and occurrences of devaluation of the coated metal strip. The removal of relatively large chunks of upper slag, so-called "lumps", can even lead to costly roller damage in the skin pass mill which is generally arranged downstream in-line.

The installation operator is consequently faced with the permanent challenge of preventing the carrying of upper slag by the coated metal strip to the greatest possible extent.

There are known different possibilities by means of which carrying of slag by the metal strip leaving the metal bath is supposed to be prevented.

Manual/mechanical methods should be mentioned here first. In practice, the upper slag is removed from the coating bath at short time intervals by workers using removal tools. This operating method has the disadvantage that the removal of upper slag is carried out in a discontinuous manner and there are consequently always time intervals—even if short—in which upper slag can come into contact with the discharged metal strip in an unimpeded manner. When the upper slag is removed manually from the direct vicinity of the metal strip leaving the melt bath, the quality of the coating can be further impaired by means of excessive agitation of the coating bath and by touching the metal strip with the scraping tool.

There are also known so-called slag removal robots which are driven in a motorised manner and which automatically remove the slag from the respective melt bath. Such slag removal robots imitate manual removal and, owing to structural circumstances, cannot be installed on every hot-dip coating installation.

Also used in practice are so-called mirror rollers which are positioned parallel with the width axis of the discharged metal strip and which remove the slag which comes into contact with them and which remains bonded to the surface thereof from the slag bath. The device described in DE 10 2006 030 914 A1 also belongs to this prior art in which a motor-driven operating means scrapes the upper slag from the coating bath surface with uniform speed. Although the use of motorised mirror rollers or motorised scraping means allows a continuous operating method, moving components are in permanent contact with the coating bath in this instance. The daily industrial routine shows here that the aggressive nature of the molten coating bath produces considerable wear in such moving components. This applies to the coating of a steel strip with an aluminium-based covering (hot-aluminium coating).

A third possibility for keeping the slag away from the metal strip leaving the melt bath involves continuous rotation of the coating bath and the installation of cooling zones by means of which slag formation can be displaced in a selective manner into surface regions of the melt bath remote from the strip path. The effectiveness of these measures can be increased by the flows within the coating bath being directed in such a manner that they act counter to the strip path. Loosened metal strip components are thereby transported away from the metal strip. Methods of this type are described in WO 2009/098362 A1, WO 2009/098363 A1, U.S. Pat. No. 5,084,094 A1, U.S. Pat. No. 6,426,122 B1 and U.S. Pat. No. 6,177,140 B1, respectively. A problem with these methods is that they partially require very complex and costly devices which in many cases cannot be retrofitted in each existing hot-dip coating installation. It has further been found that the required bath flow can be maintained within a daily industrial routine only with great difficulty. Furthermore, in the device required to carry out these methods, many mechanical components come into direct contact with the molten coating bath and are accordingly subjected to a high degree of wear.

When excess covering material is scraped from the metal strip by means of scraping nozzles which are positioned directly above the coating bath surface, high gas pressures and accordingly high flow speeds of the gas flow have the positive side-effect that a partial gas flow which is directed to the coating bath surface presses upper slag away from the metal strip being discharged. Scraping nozzles which achieve this are described, for example, in DE 43 00 868 C1 and DE 42 23 343 C1. However, the removal of the slag from the metal strip leaving the melt bath is carried out in an uncontrolled, rather random manner. With low gas pressures such as those which are adjusted in the case of low strip travel speeds or in the case of high coating thicknesses, the side-effect involving "pressing the slag away from the metal strip leaving the melt bath" does not occur.

From JP 07-145460, it is finally known to arrange a nozzle carrier transversely relative to the metal strip leaving the melt bath and parallel with the surface of the melt bath in such a manner that the gas being discharged from it the slag present on the melt bath is driven laterally with respect to the outer edge of the melt bath by gas flows which act parallel with the strip and tangentially to the surface of the melt bath and which are directed away from each other in the manner of the roof surfaces of an acutely gabled roof. The slag which is accumulated there can then be mechanically removed. However, a disadvantage of this procedure which is closest to the invention is the dead space which is inevitably produced in the region below the nozzle carrier. In this dead space, there may be an accumulation of slag which comes into contact with the strip leaving the melt bath and which leads at that location to significant surface defects at the centre of the strip width. Another disadvantage of this procedure is that the gas flows of the nozzle bar are arranged for the most part with significant spacing from the metal strip and accordingly slag is driven to a location of the surface of the melt bath on which there is no danger at all of penetration of the metal strip with slag. This leads to unnecessary gas consumption.

SUMMARY OF THE INVENTION

Against the background of the prior art explained above, the object of the invention was to provide a method and device for the hot-dip coating of metal strips which, using simple and cost-effective means, enable slag to be prevented from coming into contact with the metal strip leaving the melt bath and thus to enable an optimal surface quality to be ensured.

In a method according to the invention for hot-dip coating a metal strip with a metal covering, in accordance with the previously explained prior art, the metal strip is accordingly directed continuously through a melt bath, the thickness of the metal covering which is present on the metal strip when it leaves the melt bath is subsequently adjusted by means of a scraping device and slag which is present on the melt bath is driven away from the metal strip leaving the melt bath by means of a gas flow.

According to the invention, in order to drive away the slag by means of at least one nozzle which is arranged in close proximity to the metal strip, a gas flow which extends over the width of the metal scrip is directed onto the surface of the melt bath.

Accordingly, a device according to the invention comprises for hot-dip coating a metal strip with a metal covering a melt bath, a conveying device for continuously directing the metal strip through the melt bath, a scraping device for adjusting the thickness of the metal covering present on the metal strip when it leaves the melt bath and at least one nozzle for producing a gas flow, which drives away slag present on the melt bath from the metal strip when it leaves the melt bath.

According to the invention, the nozzle for producing the gas flow is arranged in close proximity to the metal strip and produces a gas flow which extends over the width of the metal strip and which is directed onto the surface of the melt bath.

It has surprisingly been found that, by means of a gas flow which is directed onto the surface of the melt bath and which extends over the width of the metal strip which is leaving the melt bath, surface slag present on the coating bath surface can be kept away from the leaving metal strip. In this instance, the gas flow can be readily controlled and adjusted. In particular, the pressure and influx angle of the gas flow can be adapted to the coating bath, the desired covering thickness and the strip speed and always selected in such a manner that the gas flow acts directly on the coating bath.

Consequently, using simple means and in a particularly operationally reliable manner, the risk of the occurrence of surface defects owing to contact of the covering with slag present on the melt bath is effectively reduced to a minimum.

As a result of the procedure according to the invention and the specific embodiment of a device according to the invention, there is a particularly low level of wear and a susceptibility to failure which is also low. There is consequently a high level of maintenance-friendliness and user-friendliness with minimum operational costs.

Another advantage of the invention is that existing hot-dip coating installations can be retrofitted with a device according to the invention with little complexity and can be operated in a manner in accordance with the invention. In this instance, the invention can be used independently of the composition of the melt bath processed.

Advantageously, the gas flows are orientated in such a manner that a direct flow onto the respective surface of the metal strip is prevented. As a result of a direct flow, the strip position of the metal strip in the scraping nozzle could be destabilised.

Therefore, the gas flow produced by the nozzle which is arranged according to the invention is in each case orientated in an optimum manner so that the gas flow is directed away from the metal strip transversely relative to the conveying direction of the metal strip. In this instance, the gas flow is preferably orientated in such a manner that it is orientated substantially at right angles to the surface of the metal strip associated with the respective nozzle.

Owing to a gas flow which flows away from the metal strip, it is ensured that no pulse which is also orientated transversely relative to the conveying direction of the metal strip but which is directed against the surfaces of the metal strip is caused by the gas flow to the greatest possible extent.

In the event that the gas flow flows away in a state directed away from the associated surface of the metal strip, optimum effects are achieved when the influx angle is in the range from 0-60°, in particular 0-45°. With such an orientation, it is ensured that the gas flow strikes the surface region of the melt bath which is intended to be kept free from slag with a pulse which is sufficient to drive away the slag.

The nozzle which is provided according to the invention to produce the gas flow is preferably arranged as close as possible to the metal strip, the spacing between the nozzle and the strip in practice being selected in such a manner that there is no contact between the nozzle and the strip, even in the event of fluctuations of the strip position which occur in practice. To this end, the spacing between the nozzle and the metal strip may be adjusted in the range from 50-500 mm.

In many cases, it will not be possible for the nozzle which is provided in order to produce a gas flow in accordance with the invention to be arranged in the direct vicinity of the associated surface of the metal strip. Instead, a specific minimum spacing will have to be maintained. In such a case, at least a part-flow of the gas flow which is discharged from the nozzle is preferably directed against the metal strip. Preferably, the gas flow is orientated in such a manner that the impact region on the surface of the melt bath is located in front of the metal strip and that the gas flow thus does not pass over the surface of the metal strip. In this manner, irregularities of the covering which could be caused by the gas flow striking the metal strip in front of the scraping device are prevented. Furthermore, the gas flow is prevented from destabilising the correct strip position of the metal strip on its conveying path through the scraping device.

In practice, the respective gas flow may comprise air, a gas which is inert with respect to the melt bath or a gas admixture which is formed by air and a gas which is inert with respect to the melt bath. In this instance, it has been found that an application of pressure of the gas flow supplied to the nozzles in the range from 1-15 bar under practical conditions leads to good results. The adjustment and control of the gas flow can be carried out by the operator by adjusting the horizontal, vertical and optionally axial orientation of the device according to the invention and the gas pressure. The pressure which is adjusted in each case must, on the one hand, be sufficient to drive away the upper slag from the surface of the metal strip being discharged. However, the gas pressure is not intended to exceed 15 bar, since there is the danger at excessively high pressures that the surface of the coating bath will be caused to oscillate in an undesirable manner owing to the pulse of the striking gas.

The upper slag which is "blown away" can be mechanically skimmed off the coating bath in a manner known per se with sufficient spacing from the metal strip being discharged.

Experimental observations have shown that a particularly positive effect of the method according to the invention is achieved when $N_2$ or another gas which is inert with respect to the metal covering and the melt bath is used for the gas flow. This is a result of the fact that, when nitrogen or a comparably inert gas is used in addition to purely driving away the upper slag, the re-formation of upper slag in the region covered by the gas flow is also significantly reduced.

The metal strips which are processed in a manner according to the invention are typically cold or hot-rolled steel strips.

For the melt baths, all metal melts which can be applied by means of hot-dip coating can be used. These include, for example, zinc or zinc alloy melts and aluminium or aluminium alloy melts.

Slot nozzles of a construction type known per se are, for example, suitable as nozzles for the purposes according to the invention. It is also possible to use as a nozzle a slotted or perforated pipe which acts as a slot nozzle and a nozzle unit which is provided with two or more individual nozzles which are arranged one beside the other. Practical tests have shown that the invention can also be carried out with nozzle widths which are narrower than the width of the respective metal strip to be coated. For instance, in the case of an arrangement which is central with respect to the width of the metal strip, nozzles or nozzle arrangements which extend only over 20% of the metal strip width are sufficient. However, the nozzles or nozzle arrangements may also be wider than the metal strip to be coated. However, nozzle widths of more than 120% of the metal strip width would not be economically advantageous owing to the increasing proportion of ineffectively acting gases.

Optimum protection with at the same time optimised process stability is achieved when a nozzle for driving away the slag is associated with each surface of the metal strip, respectively.

The pressure at which the gas flowing into the nozzle used according to the invention is acted on is preferably in the range from 1 to 15 bar.

BRIEF DESCRIPTION OF THE DRAWINGS

The invention is explained in greater detail below with reference to embodiments. In the schematic drawings.

DESCRIPTION OF THE INVENTION

Figure 1:
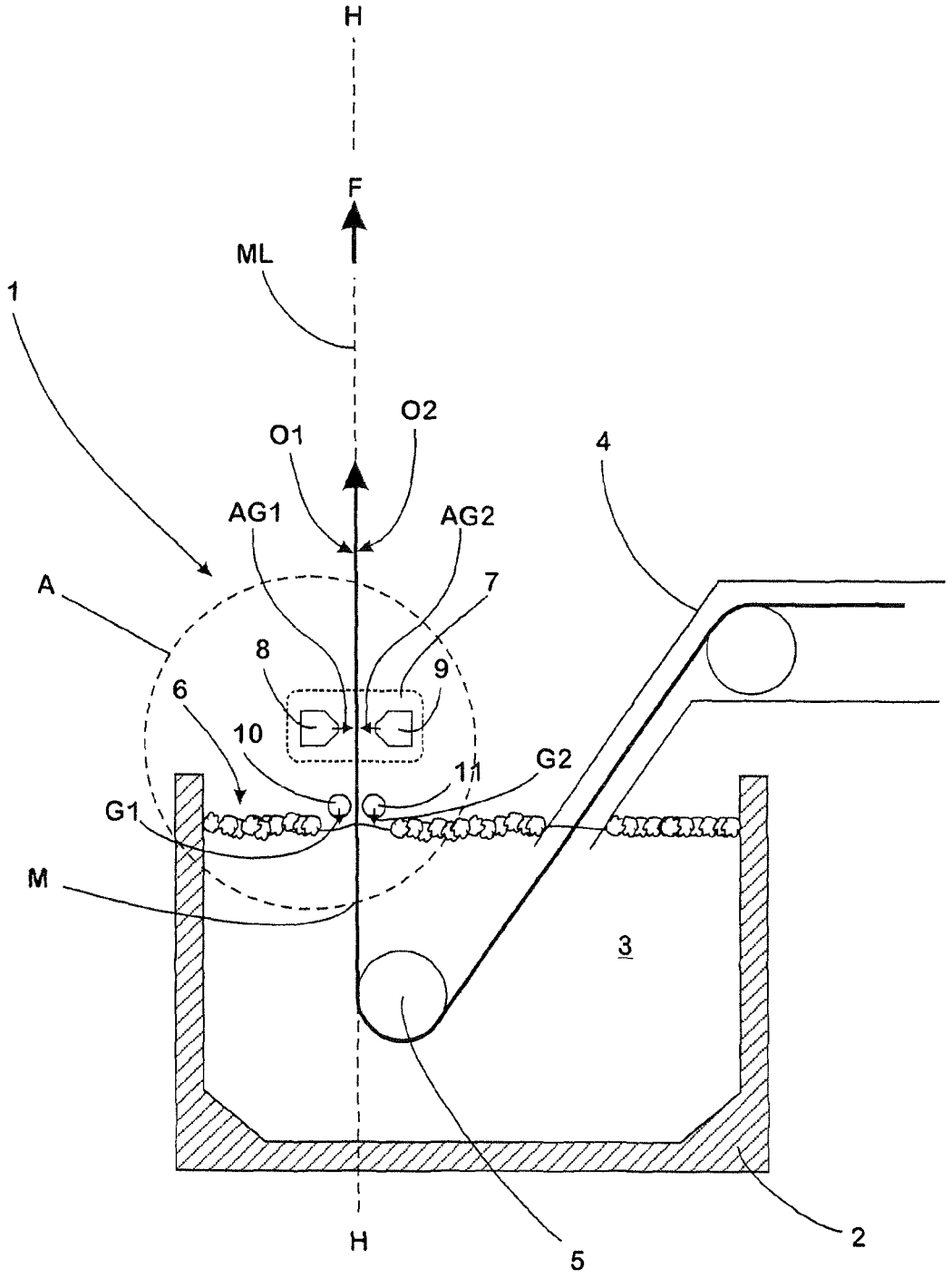
FIG. 1 is a side view of a device for hot-dip coating a steel strip.

A device 1 for hot-dip coating a metal strip M in which it is, for example, a cold-rolled steel strip comprising a corrosion-sensitive steel, comprises a melt bath 3 which is introduced in a vessel 2, in which the metal strip N which is intended to be coated and which has previously been brought to an adequate immersion temperature in a known manner is directed via a nozzle 4.

In the hot-dip bath 3, the metal strip M is redirected on a redirection roller 5 in such a manner that it is discharged from the melt bath 3 in a vertically orientated conveying direction F. In this instance, the metal strip M being discharged from the melt bath 3 passes through a scraping device 7 which is arranged with a specific spacing above the surface 6 of the melt bath 3. This scraping device 7 comprises in this instance two scraping nozzles 8, 9 which are constructed as slot nozzles and of which one directs a scraping gas flow AG1 onto one surface O1 of the metal strip M, which surface extends at one side between the longitudinal edges of the metal strip M, and the other of which directs a scraping gas flow AG2 onto the surface O2 present at the opposing side of the metal strip M.

Under optimum operating conditions, the metal strip M being discharged from the melt bath 3 is orientated in such a manner that the centre position ML thereof which is orientated centrally between the surfaces O1, O2 is located in a vertically orientated plane H.

Between the scraping nozzles 8, 9 of the scraping device 7 and the surface 6 of the melt bath 3, there is arranged at each side of the metal strip M with a spacing d of 200 mm a nozzle 10, 11 which produces a gas flow G1, G2 which extends over the width B of the metal strip M, respectively.

The nozzles 10, 11 may be constructed as conventional slot nozzles. However, there have been tested in practice as nozzles 10, 11 air bars which comprised a pipe having an inner diameter of 20 mm and in which twelve cylindrical nozzle openings each having a diameter of 2 mm were drilled, with a spacing of 25 mm, respectively. The gas supply was carried out centrally. In the embodiment tested in practice, the air bar used was approximately 300 mm wide and orientated centrally with respect to the 1370 mm width B of the metal strip M.

Figure 2:
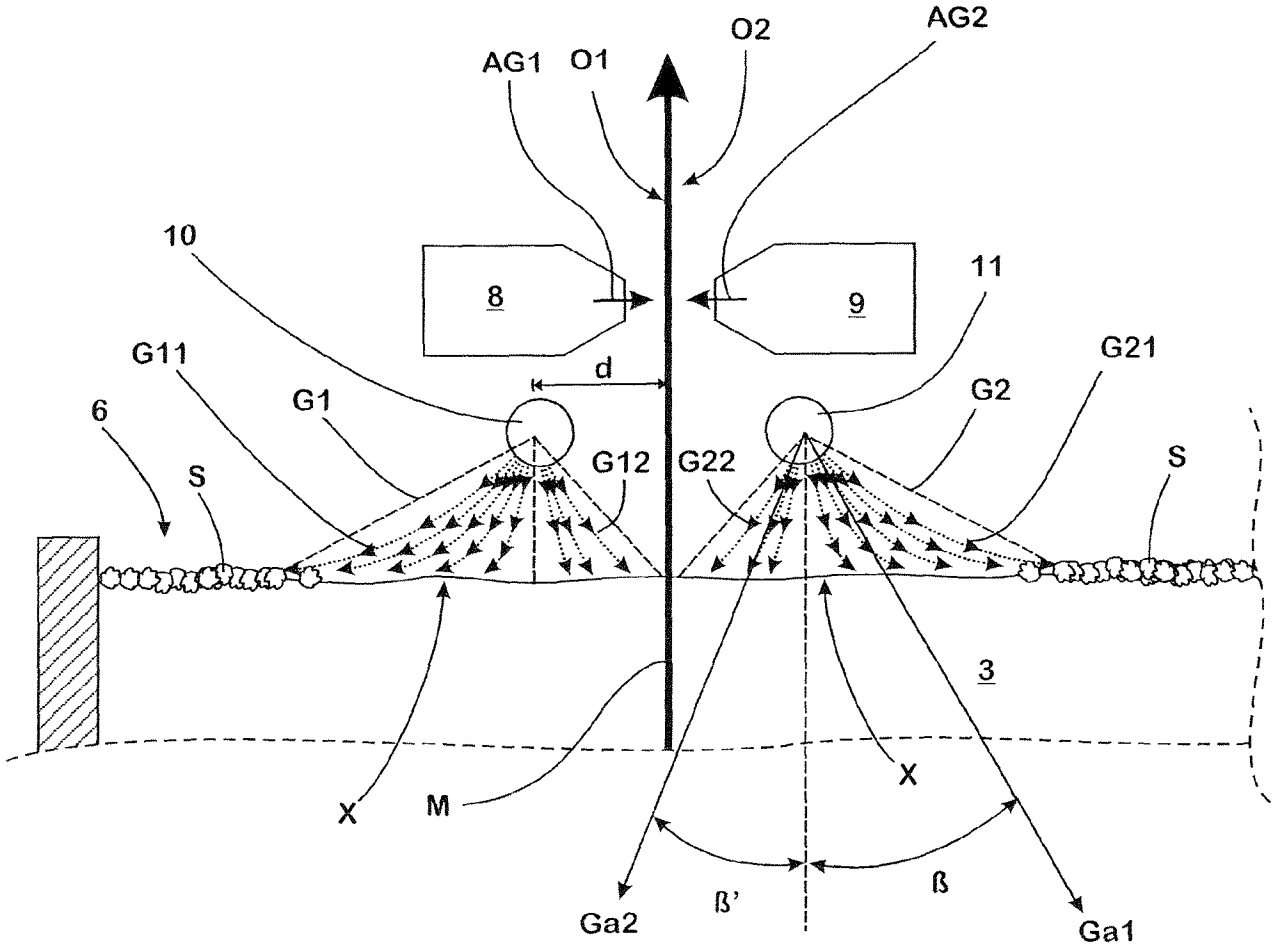
FIG. 2 is an enlarged cut-out A from FIG. 1.

In the operating method illustrated in FIG. 2, the discharge openings of the nozzles 10, 11 are orientated in such a manner that a relatively large part-flow G11, G21 of the respective gas flow G1, G2 is directed onto the surface of the melt bath 3 with the centre axis Ga1 thereof in each case at an influx angle β of approximately 30° in relation to the perpendicular relative to the surface of the melt bath 3, and at that location flows from the associated surface O1, O2 of the metal strip M in a flow direction which is directed away substantially normally with respect to the respective surface O1, O2. A smaller part-flow G12, G22 of the respective gas flow O1, O2 is in contrast directed against the associated surface O1, O2 of the metal strip. In this instance, the influx angle β' of this part-flow G12, G22 in relation to the perpendicular relative to the melt bath 3 is selected in such a manner that the border of the impact region X associated with the metal strip M, in which region the respective gas flow G1, G2 strikes the surface 6 of the melt bath 3, terminates with little spacing in front of the metal strip M. The surfaces O1, O2 of the metal strip M provided with the metal covering are thus not touched by the associated gas flow G1, G2.

Figure 3:
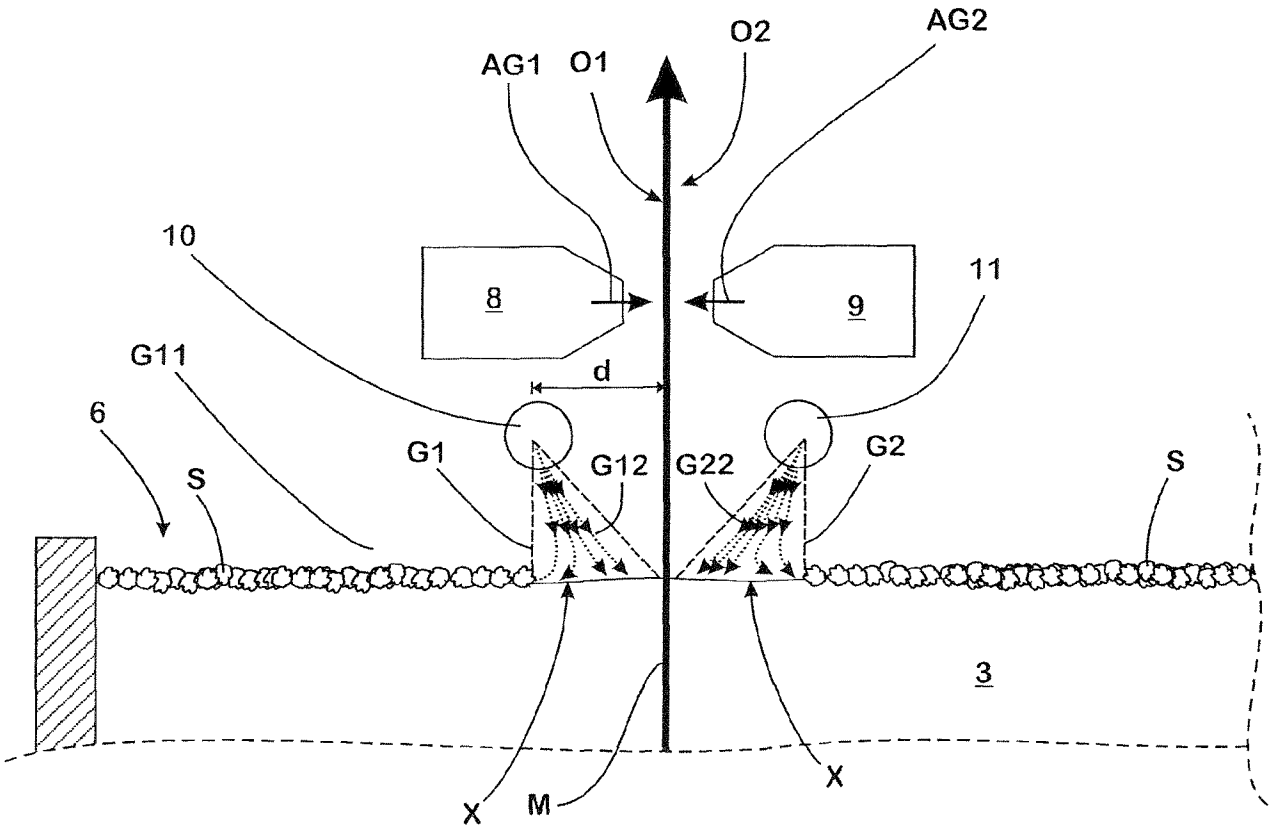
FIG. 3 shows the device according to FIG. 1 corresponding to FIG. 2 in an alternative operating mode.

In the operating method illustrated in FIG. 3, the nozzles 10, 11 are adjusted in such a manner that they do not produce any part-flows G12, G22 which are directed in the direction of the metal strip M.

Figure 4:
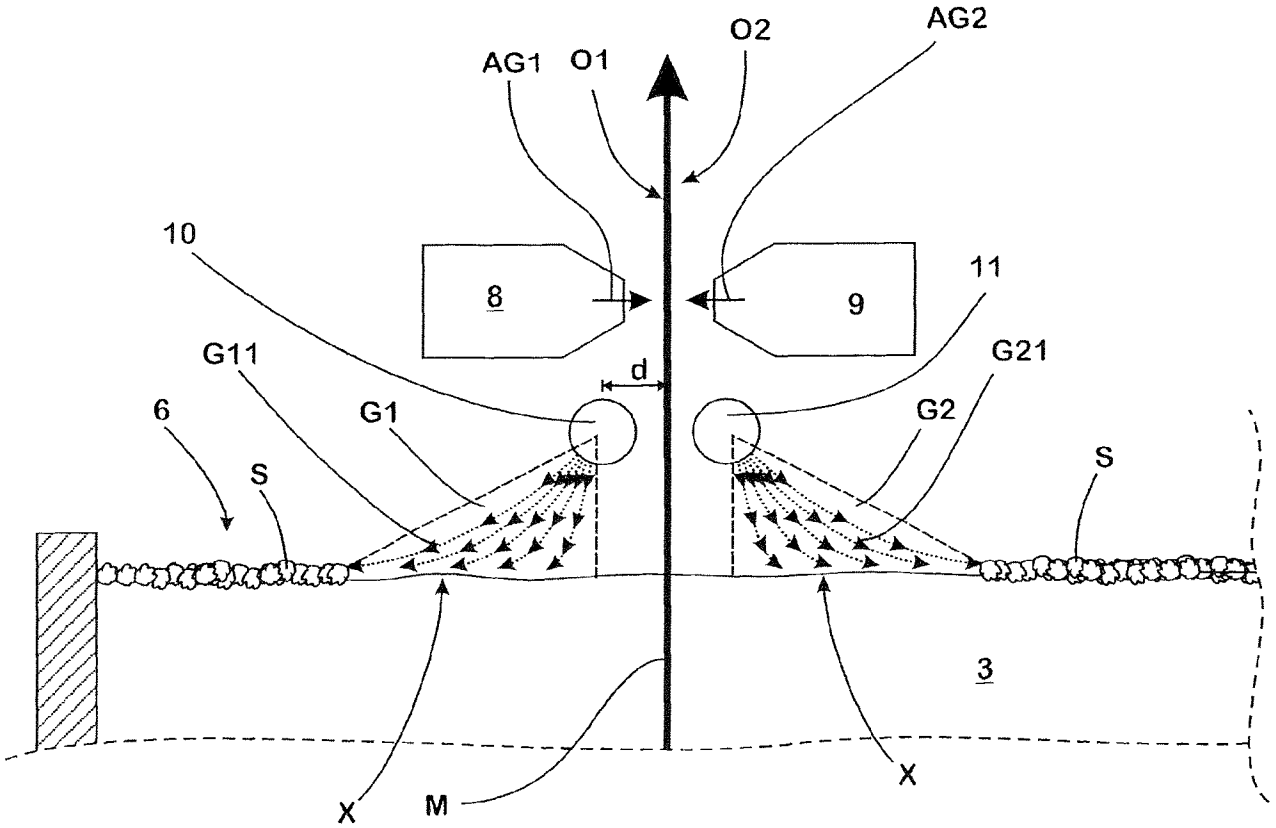
FIG. 4 shows the device according to FIG. 1 corresponding to FIG. 2 in another alternative operating mode.
Figure 5:
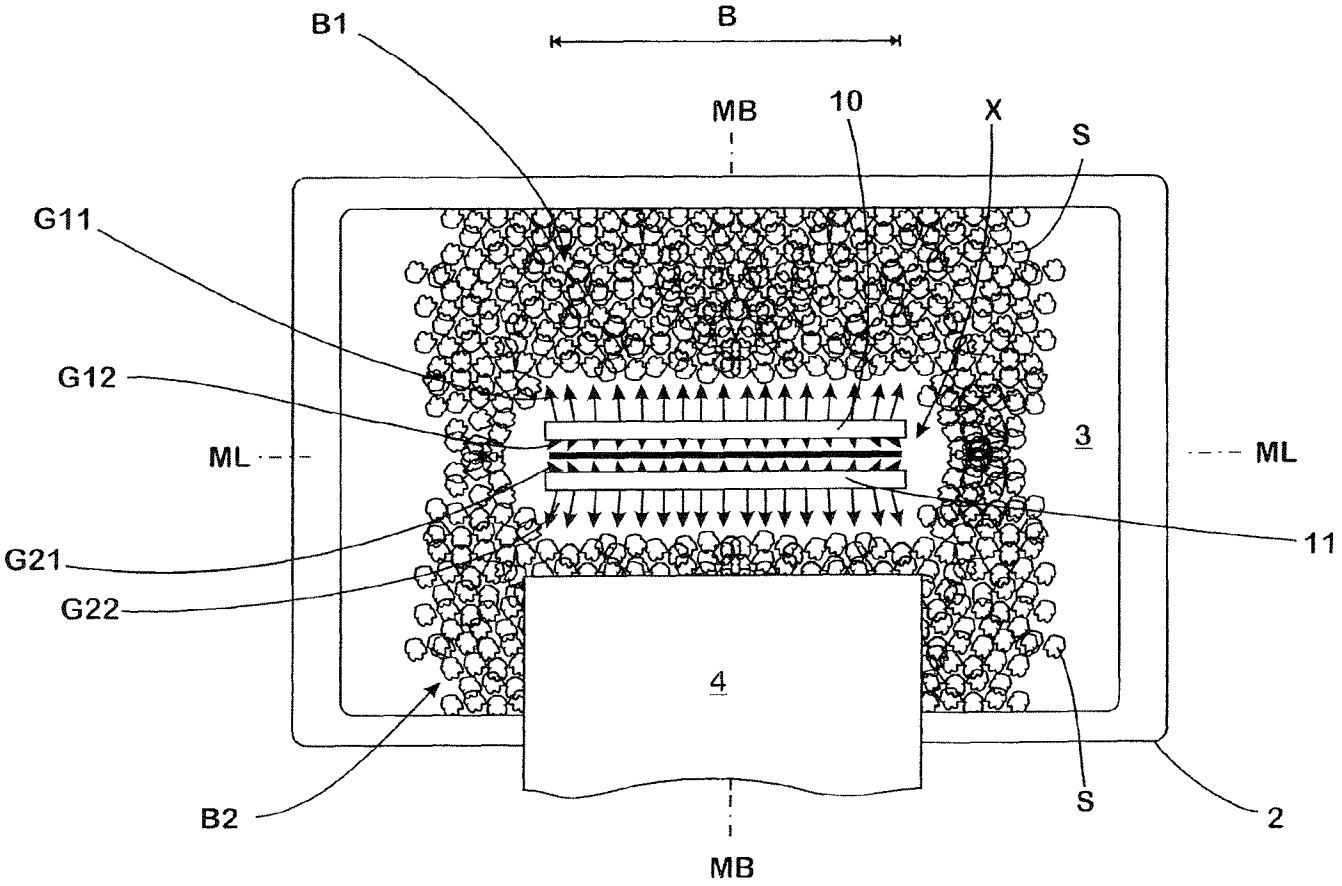
FIG. 5 is a top view of the device according to FIGS. 1 and 2.

In the operating method illustrated in FIG. 4, the nozzles 10, 11 are in contrast adjusted in such a manner that they do not produce any part-flows G11, G21 directed away from the metal strip M.

Regardless of whether the gas flows G1, G2 have been produced partially or completely so as to be directed onto the metal strip M or away from it, the gas flows G1, G2 drive the slag S present on the melt bath 3 away from the metal strip M in a direction orientated transversely with respect to the metal strip M so that they accumulate in each case in a region B1, B2 which is non-critical for the metal strip M and which is sufficiently spaced apart, and from there can be removed mechanically, that is to say, manually or by means of a suitable motor-driven device, from the surface 6 of the melt bath 3.

For operational tests, on a large-scale industrial hot-dip coating installation, during the hot aluminium coating, an $N_2$ gas flow was blown between the melt bath and scraping nozzles by means of two air bars arranged in the manner of the nozzles 10, 11. The coating bath contained 9.5% by weight of Si, 2.5% by weight of Fe and the balance being Al and traces of other elements and inevitable impurities. The speed of the metal strip being discharged from the melt bath was 38 m/min at a layer thickness to be applied of a minimum 75 g/m$^2$ per side of the metal strip M.

Upper slag which was blown away was removed from the aluminium bath surface in a manual/mechanical manner. Over a relatively long production time, surface defects resulting from carried-along upper slag was able to be effectively reduced or prevented.

Table 1 shows for a slot nozzle which is arranged in a manner according to the invention below the scraping nozzles that this good result was not achieved if no gas flow was applied or if the peripheral conditions provided for according to the invention were deviated from.

LIST OF REFERENCE NUMERALS

1 Device for hot-dip coating
2 Vessel
3 Melt bath
4 Nozzle
5 Redirection roller
6 Surface of the melt bath 3
7 Scraping device
8, 9 Scraping nozzles
10, 11 Nozzles
β, β' Influx angle
AG1,AG2 Scraping gas flows
B Width of the metal strip M
B1, B2 Regions of the surface 6 of the melt bath 3
d Spacing
F Conveying direction
G1,G2 Gas flows
G11-G22 Part-flows of the respective gas flow G1, G2
Ga1,Ga2 Centre axes of the gas flows G1, G2
H Vertically orientated plane of the central position ML
M Metal strip
ML Central position
O1,O2 Surfaces of the metal strip M
S Slag
X Impact region

TABLE 1

| Test | Gas pressure [bar] | Influx angle [°] | Surface defects as a result of upper slag? | In accordance with the invention? |
|---|---|---|---|---|
| 1 | no gas flow | | frequently | No |
| 2 | 0.5 | 45 | frequently | No |
| 3 | 1.0 | 45 | sporadically | Yes |
| 4 | 2.0 | 45 | sporadically | Yes |
| 5 | 4.0 | 45 | none | Yes |
| 6 | 6.0 | 50 | sporadically | Yes |
| 7 | 8.0 | 50 | sporadically | Yes |
| 8 | 10.0 | 50 | none | Yes |
| 9 | 12.0 | 50 | none | Yes |
| 10 | 14.0 | 5 | none | Yes |
| 11 | 16.0 | 5 | frequently | No |
| 12 | 15.0 | 5 | none | Yes |
| 13 | 10 | direct application of flow to the metal strip | frequently with significant fluctuations in distribution | No |
| 14 | 10 | 70 | frequently | No |
| 15 | 10 | 80 | frequently | No |

The invention claimed is:

1. A device for hot-dip coating a metal strip with a metal covering, comprising a melt bath, a conveying device for continuously directing the metal strip through the melt bath, a scraping device above a surface of the melt bath for adjusting the thickness of the metal covering present on the metal strip when it leaves the melt bath, and at least one nozzle for producing a gas flow, wherein the nozzle for producing the gas flow is arranged in close proximity to the metal strip and the gas flow extends over the width of the metal strip and is directed onto the surface of the melt bath, the gas flowing from the at least one nozzle for producing gas flow does not contact a surface of the metal strip and is directed away from the surface of the metal strip in a direction that is at an angle to the metal strip, the at least one nozzle is arranged with a spacing of 50-500 mm from the surface of the metal strip, and the at least one nozzle extends over at least 20% of the width of the metal strip.

2. The device according to claim 1, wherein the nozzle for driving away the slag is associated with each surface of the metal strip.

3. The device according to claim 1, wherein the nozzle is a slot nozzle or a slotted pipe.

4. The device according to claim 1, wherein the nozzle is formed by a nozzle bar in which a plurality of nozzle openings are arranged with spacing from each other.

5. The device according to claim 3, wherein the nozzle is arranged centrally with respect to the width of the metal strip leaving the melt bath.

* * * * *